US011447939B2

(12) United States Patent
Pendlebury

(10) Patent No.: US 11,447,939 B2
(45) Date of Patent: Sep. 20, 2022

(54) ENVIRONMENTALLY-FRIENDLY SHOWER WATER RECYCLING SYSTEM

(71) Applicant: Leonard Pendlebury, Bolton (GB)

(72) Inventor: Leonard Pendlebury, Bolton (GB)

( * ) Notice: Subject to any disclaimer, the term of this patent is extended or adjusted under 35 U.S.C. 154(b) by 3 days.

(21) Appl. No.: 16/954,198

(22) PCT Filed: Dec. 11, 2018

(86) PCT No.: PCT/GB2018/053586
§ 371 (c)(1),
(2) Date: Jun. 15, 2020

(87) PCT Pub. No.: WO2019/116018
PCT Pub. Date: Jun. 20, 2019

(65) Prior Publication Data

US 2020/0318323 A1 Oct. 8, 2020

(30) Foreign Application Priority Data

Dec. 13, 2017 (GB) ..... 1720736

(51) Int. Cl.
*E03B 1/04* (2006.01)
*A47K 3/28* (2006.01)
(Continued)

(52) U.S. Cl.
CPC ..... *E03B 1/044* (2013.01); *A47K 3/28* (2013.01); *E03C 1/025* (2013.01); *E03C 1/12* (2013.01);
(Continued)

(58) Field of Classification Search
CPC .. A47K 3/28; E03C 1/025; E03C 1/12; E03B 1/044; E03B 2001/045; E03B 2001/80
(Continued)

(56) References Cited

U.S. PATENT DOCUMENTS 4,398,308 A * 8/1983 Berg ..... A47K 3/28 4/598
5,293,654 A 3/1994 Castwall et al.
(Continued)

FOREIGN PATENT DOCUMENTS

CN 101579198 A 11/2009
ES 2262440 A1 11/2006
(Continued)

*Primary Examiner* — Tuan N Nguyen
(74) *Attorney, Agent, or Firm* — Virtual IP Law, LLC

(57) ABSTRACT

An electric water-recycling shower system comprising a first heating element, a fresh water intake arranged to pass the first heating element, an intake valve to control the flow of water through the fresh water intake, a water output, and a shower waste, wherein during a normal mode of operation, the intake valve is configured to allow a flow of water from the fresh water intake to pass by the first heating element and out of the water output, characterised in that the system is adapted to switch between the normal mode and a recycle mode of operation, the recycle mode comprising a waste water intake, and a waste valve connected to the shower waste, wherein the waste valve is configured to close in order to allow collection of waste water for diversion of water through the waste water intake, past a heating element and out of the water output.

21 Claims, 1 Drawing Sheet

(51) Int. Cl.
*E03C 1/02* (2006.01)
*E03C 1/12* (2006.01)

(52) U.S. Cl.
CPC ..... *E03B 2001/045* (2013.01); *E03C 2201/80* (2013.01)

(58) Field of Classification Search
USPC ..... 4/598
See application file for complete search history.

(56) References Cited

U.S. PATENT DOCUMENTS

| | | | |
|---|---|---|---|
| 2009/0300839 | A1 | 12/2009 | Gay |
| 2011/0289672 | A1 | 12/2011 | Cummings |
| 2014/0053909 | A1 | 2/2014 | Savage |
| 2016/0319522 | A1 | 11/2016 | Sparre et al. |
| 2017/0145669 | A1 | 5/2017 | Klicpera et al. |

FOREIGN PATENT DOCUMENTS

| | | | |
|---|---|---|---|
| WO | 2018124960 | A1 | 7/2018 |
| WO | 2018231131 | A1 | 12/2018 |

* cited by examiner

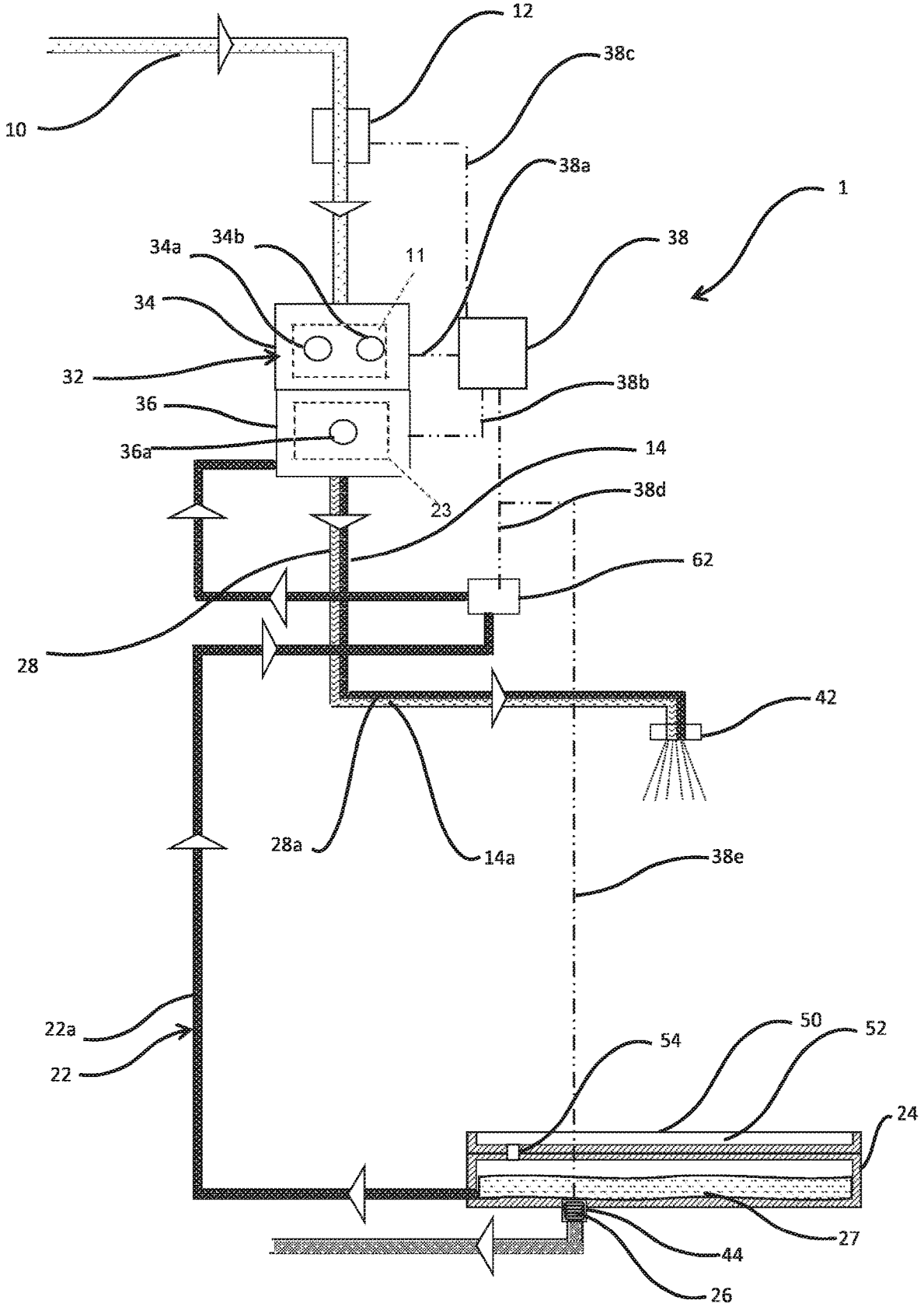
12
38c
10
38a
1
34a
34b
11
38
34
32
38b
36
36a
14
23
38d
62
28
42
28a
14a
38e
22a
22
54
50
52
24
27
44
26

ENVIRONMENTALLY-FRIENDLY SHOWER WATER RECYCLING SYSTEM

RELATED APPLICATIONS

This patent is a National Entry Phase of PCT Patent Application PCT/GB2018/053586 filed Dec. 11, 2018, which claims priority to Great Britain application 1720736.6 filed Dec. 13, 2017. All references cited in this section are incorporated here by reference in their entirety.

BACKGROUND

Technical Field

The present invention relates generally to the field of water recycling. More particularly, but not exclusively, the present invention concerns an environmentally-friendly water recycling system for an electric shower.

Description of the Related Art

Water recycling, being the reusing of treated wastewater for beneficial purposes such as agricultural and landscape irrigation, industrial processes, toilet flushing, and replenishing a ground water basin (referred to as ground water recharge) is well-known due to both resource and financial savings. Treatment of such water can be tailored to meet the water quality requirements of the planned reuse, for example, recycled water for landscape irrigation requires less treatment than recycled water for drinking water.

Personal hygiene regimes are one of the greatest generators of waste water in a residential environment. As such, recently there has been a focus on optimizing personal use of fresh water, with an emphasis on developing showering technology. A commonly-used solution is a closed-loop, or semi-closed loop system of water recycling that uses high-grade purification filters to clean the water being recycled for the duration of a shower. The Oas shower system offered by Orbital Systems uses a 5 litre intake of water for a single shower. Once the system is shut-off, a 'fresh' 5 litre amount of water is taken into the system for the next shower. However, due to the large amount of recycling occurring, the filters require replacement 3-4 times a year and this can become expensive.

It is an object of the present invention to address one or more of the problems of the prior art as discussed herein or otherwise.

Therefore, it is now desired to provide an improved arrangement for a water-recycling shower that is more financially sustainable.

SUMMARY OF THE INVENTION

In one aspect of the present invention there is provided an electric water-recycling shower system comprising a first heating element, a fresh water intake arranged to pass the first heating element, an intake valve to control the flow of water through the fresh water intake, a water output, and a shower waste, wherein during a normal mode of operation, the intake valve is configured to allow a flow of water from the fresh water intake to pass by the first heating element and out of the water output, characterised in that the system is adapted to switch between the normal mode and a recycle mode of operation, the recycle mode comprising a waste water intake, and a waste valve connected to the shower waste, wherein the waste valve is configured to close in order to allow collection of waste water for diversion of water through the waste water intake, past a heating element and out of the water output.

With this arrangement, the recycle mode returns heated waste water through the system for re-use, which not only requires minimal heating (having being already heated) thereby saving energy, but also reduces the consumption of fresh water, thereby saving money on water for a consumer and contributes the water-saving on an environmental scale.

Preferably, the recycle mode comprises a second heating element. Preferably the second heating element comprises a lower wattage (KW) than the first heating element. Preferably, the first heating element comprises 10 KW. Preferably, the second heating element comprises, lower than 10 KW, more preferably, lower than 5 KW, most preferably 1 KW.

Alternatively, the recycle mode uses the first heating element.

Preferably, in normal mode, the intake valve is arranged to open the fresh water intake. In normal mode, the waste valve may be open to allow all water passing through the shower waste to exit the system.

Preferably, the system comprises a waste water storage reservoir.

Preferably, the system comprises a shower tray. The shower tray may comprise a cavity depth of at least 5 cm. Preferably, the shower tray comprises the shower waste and the waste water valve. Preferably, the waste valve may be configured to close in order to allow collection of waste water in the shower tray for diversion of water through the waste water intake.

Alternatively, the waste water intake may be connected to a waste water tank. The waste valve may be configured to close in order to allow collection of waste water in the tank for diversion of water through the waste water intake. The waste water storage tank may be disposed below the shower tray. The tank may be connected to said shower tray via a plug hole. The tank may comprise the shower waste and the waste water valve.

Preferably, in recycle mode, the waste valve is closed to prevent water passing through the shower waste and to be stored in the tank or the tray for return to the waste water intake. Preferably, in recycle mode the fresh water intake valve is closed. However, the waste valve and/or the shower waste preferably also, comprise a restricted flow design to slow the exit of water (even in normal mode) from the system and allow collection/retention of waste water in the tank or shower tray. This restricted flow design allows water to accumulate from the beginning of a shower cycle, which allow feet to be bathed and sufficient water to collect.

Preferably, the switch from normal mode to recycle mode comprises the rearrangement of the intake valve to close the fresh water intake and close the waste valve and therefore, the shower waste.

Preferably, the switch from normal mode to recycle mode comprises an intermediate mode. Preferably, in intermediate mode, the waste valve is closed and the fresh water intake valve is arranged to remain open.

Preferably, the switch from recycle mode to normal mode comprises the rearrangement of the fresh water intake valve to open the fresh water intake and open the waste valve and therefore, the shower waste.

Preferably, the switch between the normal, intermediate and recycle mode is programmed.

Preferably, the system is programmed to initially operate in the normal mode for a first predetermined period of time. Preferably, the system is programmed to switch to the intermediate mode after said first predetermined period of time. Preferably, the first predetermined period of time comprises at least 1 minute, more preferably, 2 minutes.

Preferably, the system is programmed to switch from intermediate mode to recycle mode for a second predetermined period of time. Preferably, the system is programmed to switch to the recycle mode after said second predetermined period of time. Preferably, the second predetermined period of time comprises at least 30 seconds, most preferably, approximately 1 minute.

Preferably, the system is programmed to switch from recycle mode back to the normal mode (returning stint) after a third predetermined period of time. Preferably, the third period of time comprises between approximately 1 minute and 5 minutes, most preferably, between 1 minute and 3 minutes.

Preferably, the returning stint normal mode comprises a fourth predetermined period of time. Preferably, the fourth period of time comprises between approximately 1 minute and 4 minutes, most preferably, approximately 2 minutes.

Preferably, the system is programmed to switch back and forth between normal mode and recycle mode, via said intermediate mode during the duration of a shower after said predetermined periods of time.

Most preferably, the system comprises a shower pre-shutdown function, which once initiated by a user, switches the system back into normal mode for a short pre-shutdown predetermined period of time before turning off the shower. Preferably, the pre-shutdown predetermined period of time comprises at least approximately 30 seconds, preferably approximately 1 to 2 minutes.

Alternatively, one or more of the switches between the normal and recycle mode is manually operated by a user. Preferably, therefore, the system comprises a normal mode user-operated button and/or a recycle mode user-operated button that are operational during the duration of a shower. This allows the user to control the waste/fresh water flow. Preferably, at least a switch from recycle mode to normal mode may be designated by the user with the use of the normal mode user-operated button. Preferably, the system comprises both manual function and a programmed function, to be chosen by a user.

Preferably, the waste valve comprises a solenoid valve disposed within the shower waste. The solenoid valve may provide the restricted flow design.

Preferably, the system comprises a syphon tube between the waste water tank and the water output adapted to facilitate the movement of waste water from the shower waste, past the heating element to the water output in recycle mode.

Preferably, the system comprises a pump adapted to facilitate the movement of waste water from the shower waste to the heating element in recycle mode.

Preferably, the system comprises a control unit. Preferably, the control unit comprises the aforementioned user-operated buttons. Preferably, the control unit comprises said heating element therein. Preferably, the control unit comprises a circuit board for controlling manual and programmed functions.

Preferably, the pump is disposed outside the control unit between said control unit and the waste valve. Preferably, however, the pump is electronically connected to the circuit board for control thereby.

Preferably, the waste valve is electronically connected to the circuit board for control thereby.

Preferably, the system comprises a thermostat located in the control unit adapted to check and regulate the temperature of the water exiting the water output. Preferably, the system comprises a user-operated temperature control linked to the thermostat. The user-operated temperature control may be in the form of a dial.

Preferably, the control unit comprises indicator lights to display the mode in operation.

BRIEF DESCRIPTION OF THE DRAWINGS

For a better understanding of the invention, and to show how exemplary embodiments may be carried into effect, reference will now be made to the accompanying drawings in which:

FIG. 1 is a flow diagram of an exemplary embodiment of a water-recycling electric shower system.

DETAILED DESCRIPTION OF THE EXEMPLARY EMBODIMENTS

As shown in FIG. 1, the invention comprises an electric water-recycling shower system 1 comprising a first heating element 11, a fresh water intake 10 arranged to pass the first heating element, an intake valve 12 to control the flow of water through the fresh water intake 10, a water output 42, and a shower waste 44, wherein during a normal mode of operation, the fresh water intake valve 12 is configured to allow a flow of water from the fresh water intake 10 to pass by the first heating element and out of the water output 42, characterised in that the system 1 is adapted to switch between the normal mode and a recycle mode of operation, the recycle mode comprising a waste water intake 22 connected to a waste water tank 24, and a waste valve 26 connected to the shower waste 44, wherein the waste valve 26 is configured to close in order to allow collection of waste water n the tank 24 for diversion through the waste water intake 22, past a second heating element 23 and out of the water output 42.

The fresh water intake 10 comprises the standard plumbed cold water pipe provided in a bathroom/wet room and the intake valve 12 comprises a solenoid valve installed on said pipe.

The fresh water intake is plumbed into a control unit 32. In an exemplary embodiment of the invention, the control unit 32 comprises a housing separated into two modules: a first normal module 34; and a second recycle module 36.

The first module 34 houses a first heating element 11 that is of a suitably high wattage, ideally 10-12 KW, to allow heating of cold water on demand to an appropriate temperature. The fresh water intake is plumbed into the first module 34 of the control unit 32 and is arranged to pass by the first heating element 11 to heat the water appropriately. The newly heated fresh water 14*a* is exited from the control unit 32 via a dedicated pipe 14 to the water output 42, being a shower head. The first module 34 provides a number of indicators 34*a*, 34*b* configured to show the different modes of use provided by the first module 34.

The second module 36 houses a second heating element 23 that is of significantly lower wattage than the first, ideally 1-2 KW, to allow re-heating/top-up heating of already heated waste water 22*a* to the required temperature. The waste water intake 22, in the form of a syphon tube, is plumbed into the second module 36 of the control unit 32 and is arranged to pass by the second heating element 23 to re-heat the water appropriately. The re-heated waste water 28*a* is exited from the control unit 32 via a dedicated pipe 28 to the water output 42. The location of the two pipes 14, 28 are adjacent one another for ease. The second module 36 provides an indicator 36*a* configured to show the recycle mode in operation provided by the second module 36.

A power switch (not shown) and a heating control (not shown) is provided on the control unit 32 to allow a user to switch on the system when having a shower and control the temperature respectively. However, it is to be appreciated that there may be additional user-operated buttons can be provided for additional user-control, e.g. selection of the switching between modes of use.

The system 1 comprises a shower tray 50, which may be relatively standard in design. The waste water tank 24 is concealed under the shower tray 50, either in the sub-floor, or sitting within a purpose-built, floor-standing unit. The shower tray 50 comprises a recess 52 for the waste water before being exited down a waste hole 54. In this respect, the shower tray 50 differs from a standard installation, in that the waste hole 54 connects the recess 52 of the shower tray 50 with the waste water tank 24, into which water exiting down the waste hole 54 is diverted.

The waste water tank 24 comprises closed container with the connection to the waste hole 54 and a connection to the shower waste 44 at a lowest point thereof. Appropriately, although not shown, the tank 24 is shaped at a base to provide a slight slope towards the shower waste 26. Disposed within the shower waste 44 is the waste valve 26 in the form of a solenoid valve.

The waste water tank 24 also comprises a connection to the waste water intake 22 in the form of a syphon tube. The waste water intake 22 is disposed at the base proximal to the shower waste 44 in order to take advantage of the slope and divert water from the tank 24 when the tank contains a reservoir of waste water 27.

A pump 62 is disposed along the waste water intake 22, between the tank 24 and the second module 36 of the control unit 32. The pump is arranged to assist the drawing of waste water 22*a* from the tank 24 to the control unit 32.

The control unit 32 comprises a controller 38 that is electronically connected thereto. The controller 38 is electronically connected to the first and second modules 34, 36 via connections 38*a* and 38*b*, respectively, which control the heating elements and the user buttons and indicators. The controller provides further electronic connections: 38*c* to the intake valve 12; 38*d* to the pump 62; and 38*e* to the waste (solenoid) valve 26.

The controller 38 is ideally housed within the casing of the control unit 32.

In use, in an exemplary embodiment, the controller 38 is pre-programmed to initiate a schedule of phased electronic signals to accurately control the modes of operation during a shower once an on-switch has been depressed by a user.

First of all, the controller 38 sends a signal via 38*c* to open the water intake valve 12, via 38*a* to the first module 34 of the control unit 32 to allow heating of the first heating element at the same time as providing the appropriate indicator showing that normal mode is in operation, and via 38*e* to open the waste water valve 26. This process allows fresh water to enter via the valve 12 to be heated to by the first heating element and then go on to the water output 42 where it is exited. The controller 38 provides this normal mode for a predetermined first period of time of 2 minutes.

Once the first predetermined period of time is finished, the controller 38 sends a signal via 38*a* to the first module 34 of the control unit 32 to provide the appropriate indicator showing that normal mode has switched to an intermediate mode of operation, and via 38*e* to close the waste water valve 26. This process allows fresh water to continue to enter via the valve 12 and to be heated to by the first heating element and then go on to the water output 42 where it is exited. However, as the waste valve 26 is closed, the tank 24 is allowed to fill with the heated (now) waste water 27. The controller 38 provides this intermediate mode for a predetermined second period of time of 1 minute.

Following the expiration of the second predetermined period of time, the controller 38 sends a signal via 38*c* to close the water intake valve 12, via 38*b* to the second module 36 of the control unit 32 to allow heating of the second heating element at the same time as providing the appropriate indicator showing that recycle mode is in operation, and via 38*e* to open the waste water valve 26. The first heating element is now off. This process allows waste water the drawn through the syphon tube 22 from the waste water tank 24 and be re-heated by the second heating element and then go on to the water output 42 where it is exited. The controller 38 provides this recycle mode for a predetermined third period of time of 5 minutes.

After the recycle mode is complete, the controller 38 sends a signal via 38*c* to open the water intake valve 12, via 38*a* to the first module 34 of the control unit 32 to allow heating of the first heating element at the same time as providing the appropriate indicator showing that normal mode is in operation again, and via 38*e* to open the waste water valve 26. This process allows fresh water to once again enter via the valve 12 to be heated to by the first heating element and then go on to the water output 42 where it is exited. The controller 38 provides this normal mode for a predetermined fourth period of time of 2 minutes.

It is to be appreciated that alternative programs with predetermined periods may be provided, or that the process may be entirely user-operated, with an intermediate mode built-in between the normal to recycle mode switch.

With the invention, the system can deliver a shower with pre-wash, waste water collection, recycle shower and rinse phases that correspond with the stages described above. This allows for saving of electricity as the waste water need not be heated from cold, and saving of water since the recycle mode re-uses a proportion of the water. However, due to pre-wash and rinse phases, the issue of initial grime being recycled and water becoming too dirty to finish a shower are avoided.

Although a few preferred embodiments have been shown and described, it will be appreciated by those skilled in the art that various changes and modifications might be made without departing from the scope of the invention.

The invention claimed is:

1. An electric water-recycling shower system adapted to switch between a normal mode and a recycle mode comprising:

a first heating element;

a fresh water intake arranged to pass the first heating element;

an intake valve to control the flow of water through the fresh water intake;

a water output;

a shower waste;

a waste water intake;

a waste water storage reservoir comprising a shower tray comprising a cavity depth of at least 5 cm;

a waste valve connected to the shower waste; and wherein during a normal mode of operation, the intake valve is configured to allow a flow of water from the fresh water intake to pass by the first heating element and out of the water output, and wherein in the recycle mode_the waste valve is configured to close in order to allow collection of waste water in the shower tray to divert_water through the waste water intake, past a second heating element and out of the water output.

2. The system according to claim 1, wherein the second heating element comprises a lower wattage (KW) than the first heating element.

3. The system according to claim 2, wherein the first heating element is housed in a first control unit module and comprises a suitably high wattage of at least approximately 10 KW, and the second heating element is housed in a second control unit module.

4. The system according to claim 1, wherein in normal mode, the intake valve is arranged to open the fresh water intake and the waste valve is open to allow all water passing through the shower waste to exit the system.

5. The system according to claim 1, further comprising a waste water tank disposed under the shower tray, the waste water intake is connected to the waste water tank comprising the shower waste and the waste valve, to provide the waste water reservoir, wherein the waste valve is configured to close in order to allow collection of waste water in the tank for diversion of water through the waste water intake.

6. The system according to claim 1, wherein in recycle mode, the fresh water intake valve is closed and the waste valve is closed to prevent waterpassing through the shower waste and to be stored in the waste water reservoir for return to the waste water intake.

7. The system according to claim 1, wherein at least one of the waste valve and the shower waste comprises a restricted flow design to slow the exit of water from the system during the normal and recycle modeto allow collection of the waste water.

8. The system according to claim 1, wherein in the_recycle mode the intake valve is rearranged: to close the fresh water intake and close the waste valve and therefore, the shower waste.

9. The system according to claim 1, further comprising an intermediate mode between the and the recycle mode, and wherein in the intermediate mode the waste valve is closed and the fresh water intake valve is arranged to remain open.

10. The system according to claim 1, wherein in the_normal mode the intake valve is rearranged to open the fresh water intake and open the waste valve and therefore, the shower waste.

11. The system according to claim 9, wherein the system is programmed to initially operate in the normal mode for a first predetermined period of time of at least 1 minute and switch to the intermediate mode.

12. The system according to claim 11, whereinthe system is programmed to switch from intermediate mode to recycle mode for a second predetermined period of time of at least 30 seconds.

13. The system according to claim 12, wherein the system is programmed to switch from recycle mode back to the normal mode after a third predetermined period of time between approximately 1 minute and 5 minutes.

14. The system according to claim 13, wherein returning to normal mode comprises a fourth predetermined period of time between approximately 1 minute and 4 minutes.

15. The system according to claim 1, wherein the system further comprises a shower pre-shutdown function, which once initiated by auser; switches the system back into normal mode for a short pre-shutdown predetermined periodof time before turning off the shower.

16. The system according to claim 1, wherein the switch between the normal and recycle mode is manually operated by a user.

17. The system according to claim 16, wherein the system further comprises at least one of a normal mode user-operated button and a recycle mode user-operated button that are operational during the duration of a shower.

18. The system according to claim 1, wherein the waste valve comprises a solenoid valve disposed within the shower waste.

19. The system according to claim 18, wherein solenoid valve provides the restricted flow design.

20. The system according to according to claim 1, wherein the system comprises a pump adapted to facilitate the movement of waste water from the shower waste to the heating element in recycle mode.

21. The system according to claim 1, wherein in recycle mode, the intake valve is closed and the waste valve is closed to prevent water passing through the shower waste and to be stored in the waste water storage reservoir for return to the waste water intake.

* * * * *